United States Patent [19]

Maruyama et al.

[11] Patent Number: 4,646,621

[45] Date of Patent: Mar. 3, 1987

[54] HYDRAULIC SERVO ACTUATOR

[75] Inventors: Teruo Maruyama, Hirakata; Takuya Sekiguchi, Neyagawa, both of Japan

[73] Assignee: Matsushita Electric Industrial Co., Ltd., Kadoma, Japan

[21] Appl. No.: 697,592

[22] PCT Filed: May 18, 1984

[86] PCT No.: PCT/JP84/00249

§ 371 Date: Jan. 17, 1985

§ 102(e) Date: Jan. 17, 1985

[87] PCT Pub. No.: WO84/04784

PCT Pub. Date: Dec. 6, 1984

[30] Foreign Application Priority Data

May 20, 1983 [JP] Japan ..... 58-89456

[51] Int. Cl.[4] ..... F15B 9/07

[52] U.S. Cl. ..... 91/375 R; 91/376 A; 91/459

[58] Field of Search ..... 91/375 R, 375 A, 376 A, 91/361, 362, 459; 92/121; 137/625.65, 625.21

[56] References Cited

U.S. PATENT DOCUMENTS

| | | | |
|---|---|---|---|
| 2,917,079 | 12/1959 | Verbrugge | 91/375 R |
| 2,988,059 | 6/1961 | Wysong, Jr. | 91/375 A |
| 4,177,713 | 12/1979 | Lewis et al. | 91/376 A |
| 4,458,580 | 7/1984 | Masuda et al. | 91/375 R |

FOREIGN PATENT DOCUMENTS

| | | | |
|---|---|---|---|
| 500840 | 2/1939 | United Kingdom | 91/375 R |

*Primary Examiner*—Robert E. Garrett
*Assistant Examiner*—Mark A. Williamson
*Attorney, Agent, or Firm*—Wenderoth, Lind & Ponack

[57] ABSTRACT

A hydraulic servo actuator has an outer case, a rotatable shaft extending through the case, an input sleeve rotatably mounted on the shaft and having hydraulic fluid supply and discharge passages therein and having surface grooves communicating with the passages, an output member on the shaft and movably abutting the input sleeve and having fluid supply and discharge passages therein and having surface grooves communicating with the passages and being opposed to corresponding grooves on the input sleeve, the outer casing and the output member defining an actuating chamber therebetween into which the passages in the output member open; the actuating chamber is shaped for causing the output member and the outer case to rotate relatively and rotate the shaft and case relatively when fluid supplied into the chamber from the passages under control of relatively rotation of the input and output members creates an unbalanced pressure on parts of the actuating chamber. A motor in the casing has a stator fixed to the case, and a rotor connected to the sleeve; the passages and grooves are positioned relative to each other for, when the motor is actuated to drive the rotatable input sleeve relative to the output member away from a neutral position in which the pressure of the fluid on the parts of the chamber is balanced, causing the fluid in the actuating chamber to rotate the case and the output member in a direction tending to balance the fluid pressure on the parts of the actuating chamber.

3 Claims, 9 Drawing Figures

HYDRAULIC SERVO ACTUATOR

DESCRIPTION

1. Technical Field

This invention relates to a hydraulic rotary actuator to be used for various kinds of industrial machines, instruments, and robots, and the use of this actuator can provide very compact driving parts for wrists (hands) and fingers of robots having such functions as selective positioning and control over power.

2. Background Art

With the prevalence of industrial robots in recent years, the application range of robots has become wider, and now intended is the use of robots for assembling operations with high precision and intricacy which has so far been deemed possible only by skilled workers.

However, an indispensable requisite for this purpose is to provide a manipulator possessing such functions as positioning and clamping with a high degree of freedom and high precision.

When an electrically driven actuator (DC servo, AC servo) is used, assembling of, for example, wrists and fingers having a high degree of freedom at the end of a multijoint arm of the robot is difficult because of the small power/weight ratio of a motor including reduction gears.

A hydraulic driving method using servo valves has widely been employed in the industrial field in the past but requires the provision of a pair of servo valves for each actuator.

Further, actuating oil must be separately fed to actuators and servo valves from the supply source and the structure of hydraulic pipe lines is complicated when a wrist with a high degree of freedom is provided.

When respective servo valves are provided in the body proper of a robot for reducing the weight thereof, pipe lines extending between hydraulic actuators incorporated in the wrist parts of the robot and servo valves are made very long. As a result, the servo system is unstable due to swelling of the pipes which are usually composed of resilient material, thereby causing a problem that loop gain governing the function of servo system cannot be made large.

A rotary actuator employing mechanical servos for controlling displacement, velocity, and power of the output shaft of the actuator pursuant to input signals has hitherto been used.

FIGS. 1*a* and 1*b* show a conventional type rotary actuator as mentioned above, having parts as follows:

input shaft 1; output shaft 2; guide valve sleeve 3; guide valve 4 comprising the abovesaid parts 1 and 3; setting piece 5; rotor vane 6; housing 7; supply and discharge openings for actuating oil; and packing 9 for sealing.

As shown in the drawing, the input shaft 1 is slidably received within the output shaft 2 and the guide valve 4 is formed between grooves on the surface of the input shaft 1 and other grooves on the inner surface of the guide valve sleeve 3 secured to the output shaft 2. When an angular deviation takes place between the input shaft 1 and the output shaft 2 of said actuator, the guide valve 4 opens by an amount proportional to the angular deviation and the motor generates torque in the direction in which deviation is compensated.

Then, the output shaft 2 revolves pursuant to rotation of the input shaft 1. When it is attempted to reduce the abovesaid rotary actuator in size for application thereof to, for example, a wrist and finger having a high degree of freedom, the following problems arise.

For miniaturization of the actuator, the configuration and size of the guide valve 4 composed of the input shaft 1 and the guide valve sleeve 3 must be reduced and, therefore, the groove of guide valve 4 which exerts a great influence on characteristics of the servo system is difficult to form.

A conventional structure similar to that as shown in FIGS. 1*a* and 1*b*, in which the input shaft 1 is contained within the output shaft 2 and the end of the input shaft 1 on one side extends outside the actuator, has had a problem that the sliding torque of the sealing packing 9 for prevention of oil leakage is large and miniaturization of the motor (not shown) for driving the input shaft 1 is impossible.

Further, an arrangement of uncovered piping for actuating oil to be fed to actuators causes problems, as in the case of the abovesaid hydraulic drive by means of servo valves, in miniaturization and simplification of wrists having a high degree of freedom.

DISCLOSURE OF THE INVENTION

This invention provides an actuator comprising: an input member capable of being rotated by driving means and having tubes capable of supplying and discharging oil and grooves communicating with said tubes; an output member having grooves formed on the surface thereof opposite to grooves of said input member and tubes communicating with these grooves, and including a shaft; an outer case sealingly enclosing said output member and input member and containing said driving means; an actuating chamber defined by this outer case and said output member and communicating with the tubes of said output member so as to rotate said output member by supply and discharge of oil to and from said tube; thereby enabling miniaturization of the actuator body proper and simplification of the hydraulic piping.

BEST MODE FOR CARRYING OUT THE INVENTION

An embodiment of this invention will be described hereinafter.

Figure 2:
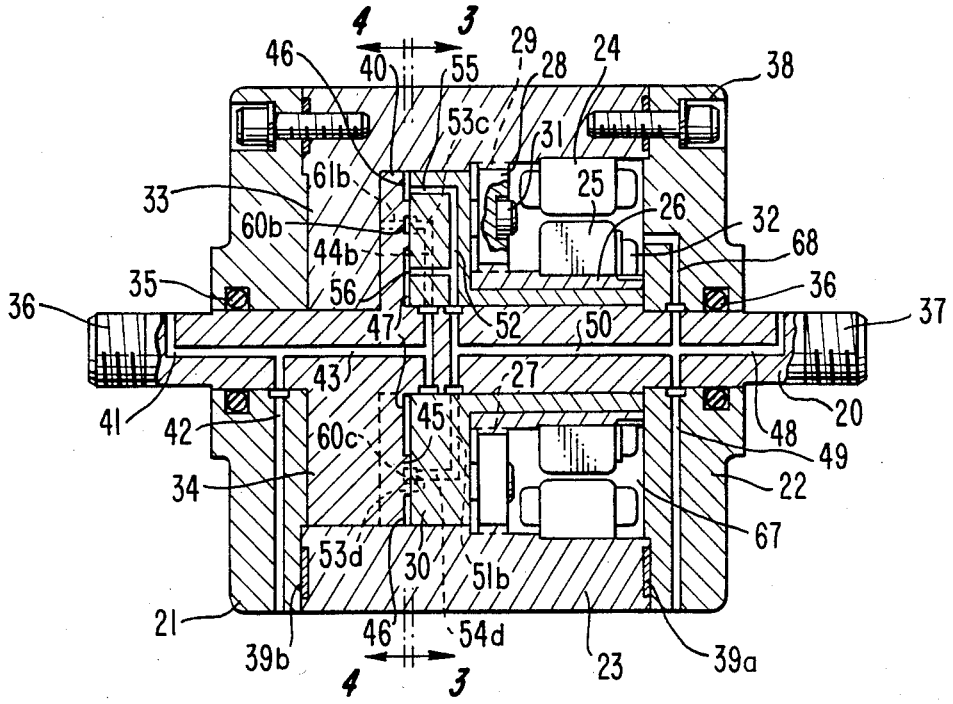
FIG. 2 is a sectional side view taken along line 2—2 of FIGS. 3 and 4 of a rotary type hydraulic servo actuator according to this invention.
Figure 3:
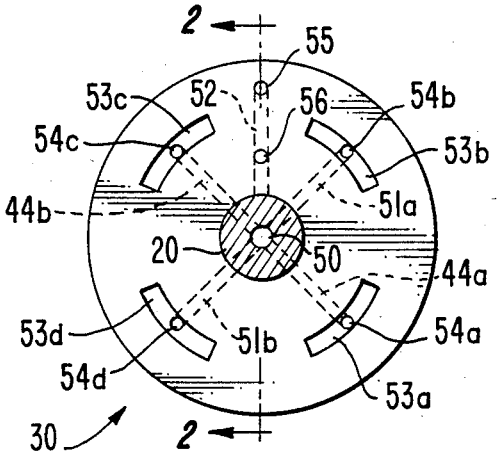
FIGS. 3 and 4 are partial sectional views taken in the direction of lines A—A and B—B in FIG. 2, respectively.
Figure 4:
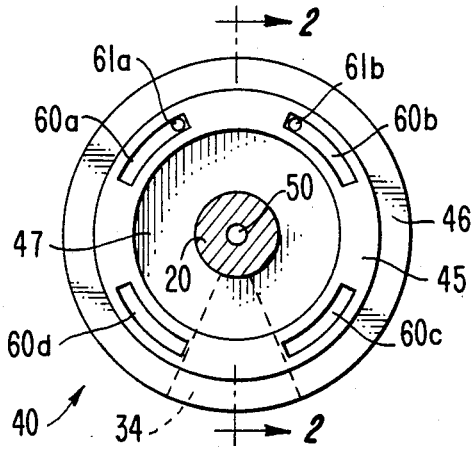

FIG. 2 is a sectional view of a hydraulic actuator according to this invention, taken on line 2—2 of FIGS. 3 and 4 having an output shaft 20; a front plate 21; a rear plate 22; a cylinder 23; a stator 24 of a pulse motor; a rotor 25 of the pulse motor; cylindrical sleeve 26; an inner sun gear 27 formed on said sleeve 26; a planet gear 28; a sun gear 29 internally formed on said cylinder on the stationary side; a guide valve sleeve 30 on the input side as an input member rotatably fitted on said output shaft 20; bolt 31 for rotatably mounting said planet gear 28 on the guide valve sleeve 30 so sleeve 30 can be driven from motor 24, 25; nut 32 for fixedly securing said rotor 25 to said sleeve 26; a stationary vane 33 formed integrally with said cylinder 23; a rotating vane 34 formed integrally with said output shaft 20; O-rings 35 and 36 inserted between said output shaft 20 and the front plate 24 and the rear plate 22, respectively; screw-threaded parts 36 and 37 on both ends of the output shaft 20; bolts 38 for securing plates 21 and 22 to the cylinder 23; oil seals 39*a* and 39*b* disposed between the cylinder 23 and plates 21 and 22, respectively; a guide valve plate 40 on the output side as an output member formed integrally with the output shaft 20; main supply passages 41 and 42 for supply of actuating oil and extending through the interior of one end of the output shaft 20 and through the front plate 21, respectively; an oil supply branch passage 43 within the shaft on the supply end and branched to a circumferential groove (unnumbered); input guide valve oil passages 44*a* and 44*b* formed in the interior of the guide valve sleeve 30 and opening into circumferential groove segments 53*a* and 53*c* in the face of sleeve 30 through passage 54*a* and 54*c*; through oil passages 61*a* and 61*b* formed in the guide valve plate 40 on opposite sides of vane 34 and extending through plate 40 from circumferential groove segments 60*a* and 60*b*; circumferential recess 46 and 47 on the radially outer side and radially inner side, respectfully, of an annular land 45 on the face of guide valve plate 40 opposed to guide valve sleeve 30; main discharge passages 48 and 49 for discharging actuating oil and extending through the interior of the other end of the output shaft 20 and of the rear plate 22, respectively; oil discharge branch passage 50 within the shaft 20 connected to the discharge passages and branched to a circumferential groove (unnumbered) in shaft 20; oil discharge passages 51*a* and 51*b* in the guide valve sleeve 30 open at the inner ends to the groove for the passage 50, and having branches 54*b* and 54*a* connected to circumferential groove segments 53*b* and 53*d* in the face of sleeve 30; and an oil discharge passage 52 in guide valve sleeve 30 and open at one end to the groove for passage 50 and having branch passages 55 and 56 opening out of the face of sleeve 30 on the radially opposite sides of land 45 and connecting recesses 46 and 47 with the oil discharge passage 50 within the shaft. Land 45 has circumferential groove segments 60*c* and 60*d* thereon positioned to cooperate with groove segments 53*a* and 53*d*, and groove segments 53*b* and 53*c* positioned to cooperate with groove segments 60*a* and 60*b*. The outer case is composed of the front plate 21, rear plate 22, and cylinder 23.

The rotor 25 is fixed to the sleeve 26 by the nut 32, the sleeve 26 revolving in proportion to the number of input pulses of the pulse motor.

The shaft of the planet gear 28 is driven by the inner sun gear 27 formed on the sleeve 26 and rotates with the input side guide valve sleeve 30.

Actuating oil is supplied to the vane chamber which is also an actuating chamber through passages as 41→43→44*a* and 44*b*→61*a* or 61*b* is discharged through passages as 51*a* or 51*b*→50→48.

Member 30 and 40 together constitute a guide valve of the face-opposed type the faces of which are shown in FIGS. 3 and 4.

The circumferential groove segments and openings thereinto are at four positions spaced equally around the shaft 20, and groove segments 53*a* and 53*c* and related groove segments 60*a* and 60*c* are symmetrical with respect to the shaft axis, as are segments 53*b* and 53*c* and 60*b* and 60*d*. The branch passages 55 and 56 discharge oil collecting in recesses 46 and 47 to the oil passage 52.

Figure 5A:
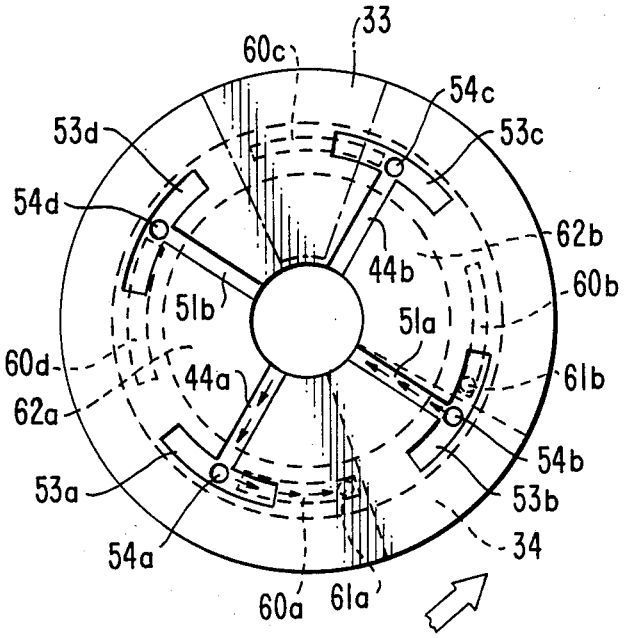
FIGS. 5*a* and 5*b* are schematic view illustrating the principle of operation of a face-opposition type guide valve of an actuator according to this invention.
Figure 5B:
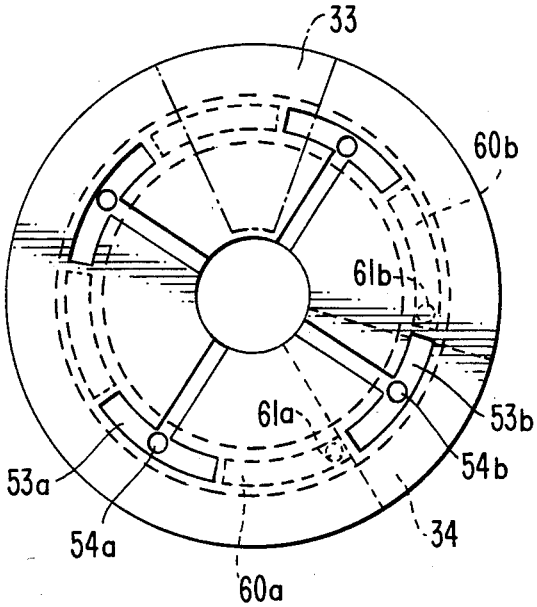

FIGS. 5(*a*) and 5(*b*) are views showing the principle of operation of the face-opposed type guide valve in an actuator according to this invention, FIG. 5*a* showing a case in which an angular deviation occurs between the input side (corresponding to sleeve 30) and the output side (corresponding to valve plate 40) whereas FIG. 5*b* shows a case in which an angular deviation is 0° (at the time of end of position).

The numerals 62*a* and 62*b* designate valve chambers (actuating chambers) on the high pressure side and low pressure side, respectively In FIG. 5(*a*), when an angular deviation occurs between input and output sides, i.e. sleeve 30 and valve plate 40 are rotated relative to each other away from the zero deviation position, actuating oil is fed from passages connected to the oil supply passages 41 and 42 to the vane chamber 62*a* on the high pressure side through passages and grooves 44*a*→54*a*→53*a*→60*a*→61*a*→62*a*.

On the contrary, on the low pressure side, oil is discharged through the passages and grooves from chamber 62*b*→61*b*→60*b*→53*b*→54*b*→51*a*.

As a result, the output shaft 20 rotates in the counterclockwise direction due to oil pressure on vane 34 to eliminate the angular deviation (as shown by an arrow mark in FIG. 5(*a*)). As shown in FIG. 5(*b*), when the overlapping of parts of the grooves on the input side and corresponding grooves on the output side (for example, 53*b* and 60*b*) ends the supply of oil and discharge of oil are interrupted and the output shaft 20 stops rotating.

The guide valve described herein is the entire body formed of two members movable relative to each other so as to enable changeover and interruption of oil flow paths extending from the oil supply source to the vane chamber as well as from the vane chamber to the oil discharge. In the embodiment shown in FIG. 2, the term "guide valve" means the combination of the guide sleeve 30 on the input side and the guide valve plate 40 on the output side.

Figure 6:
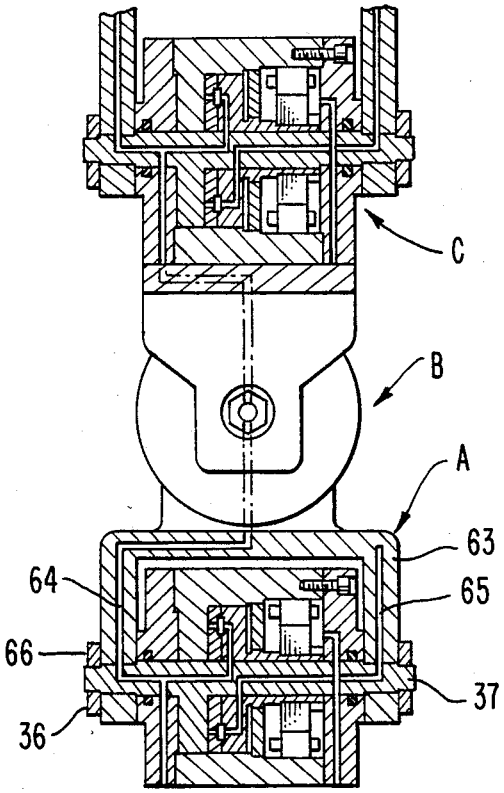
FIG. 6 is a view of the entire structure of a hand with high degree of freedom fabricated with an actuator according to this invention.

FIG. 6 is a view showing the structure of a multi-joint wrist of a robot in which hydraulic actuators A, B and C according to this invention are connected with each other in a multi-step manner. The numerals 63, 64, and 65 designate a housing, a main oil supply passage, and a main oil discharge passage, respectively.

The housing 63 and output shaft 20 are fixed to each other by threaded parts 36 and 37 on both ends of the output shaft 20 and by nuts 66.

Oil passages (corresponding to 63 and 64) for supply and discharge of oil formed within the housing 63 communicate with other oil passages (corresponding to 41, 43, 50 and 48 in FIG. 2) formed within the output shaft 20.

This invention makes it possible to fabricate a hydraulic actuator which is remarkably compact and which possesses high resolving power of positioning as compared with conventional type hydraulic actuators. In the embodiment, the pulse motor 24, 25 and reduction gears 27, 28, 29 for driving the input part (i.e. the guide sleeve 30 for operating the actuator are incorporated into the actuator.

Figure 1A:
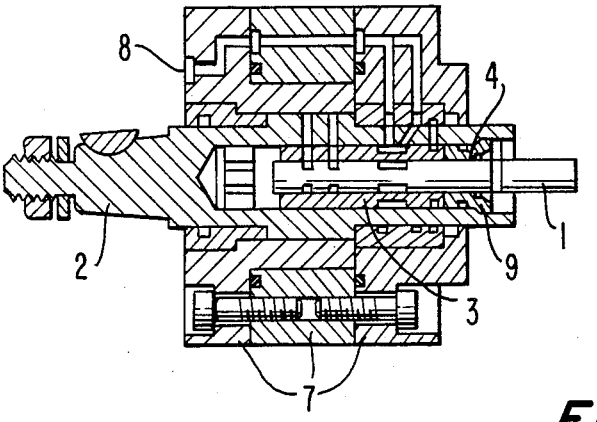
FIG. 1a. (PRIOR ART)
FIGS. 1*a* and 1*b* are a sectional side view and a front elevation of a rotary type hydraulic servo actuator according to the prior art.
Figure 1B:
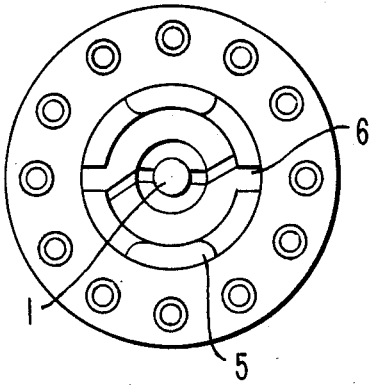
FIG. 1b. (PRIOR ART)

As shown in FIG. 1, in the conventional type actuator, a part of the input shaft 1 extends outside the hydraulic actuator, thereby causing a problem that, when a small motor is used, driving torque is insufficient due to sliding torque generated by sealing packing 9 for preventing leakage of actuating oil between the input shaft 1 and output shaft 2. In the actuator according to this invention, since sleeve 26, guide sleeve 30, and planet gear 28 on the input side are disposed within the actuator, a packing which causes an increase in sliding torque is not required. Accordingly, input torque is low and miniaturization of the motor is possible.

Further, in the actuator according to this invention, a face-opposed type guide valve enables more reduction in the size of the actuator body proper and improvement of the servo characteristics.

Figure 7:
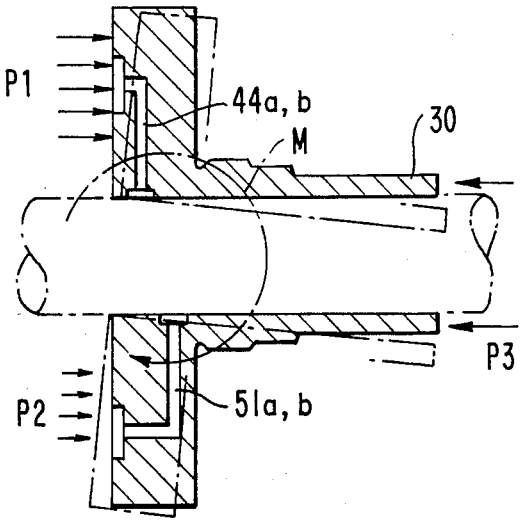
FIG. 7 is a view showing the state of forces acting upon the guide valve.

However, at the initial stage in the course of development of this invention, a problem as shown in FIG. 7 arose.

When a guide valve has thrust surfaces, pressure as indicated at $P_1$ and $P_2$ in FIG. 7 is exerted as a thrust load on the guide valve sleeve 30.

For example, assuming that pressure $P_5$ of the oil supply is 70 kg/cm$^3$ and the outer diameter of the guide valve sleeve 30 is 20 mm, a thrust load amounting to about 200 kg at the maximum is exerted on said sleeve 30.

When there is a pressure difference between $P_1$ and $P_2$ in opposite sides of shaft 20, a torsional moment M is exerted on the guide valve sleeve 30 as shown in FIG. 7, which results in a great hinderance to driving of the guide valve sleeve 30 by the use of a miniature low torque motor.

As shown in FIG. 4, the outer peripheral recess 46 and inner peripheral recess 47 are provided on one of the opposing faces of the guide valve and communication is established between these recesses and the passage 62 to the discharge for mitigating thrust load f. In addition, groove segments 53*c* as well as 53*d* are diametrically opposite groove segments 53*a* and 53*b* and groove segment 53*c* is supplied with high pressure oil and groove segment 53*d* is at low pressure for reducing the moment load M. As shown in FIGS. 4 and 5, grooves 60*d* and 60*c* are not connected with either the supply or discharge passages in the actuating shaft and are provided for the purpose of eliminating the above-said moment load.

As shown in FIG. 2, the main discharge passage 48 which is under low pressure communicates with the motor chamber 67 through the passage 68, whereby the thrust load exerted on the guide valve 30 from the right side (FIG. 2) is small.

In contrast to the conventional type actuator as shown in FIG. 1 in which the guide valve is defined between the outer peripheral part of the input shaft 1 and the inner peripheral part of the output shaft 2, in an actuator according to this invention, the guide valve is formed between thrust surfaces.

The guide valve is most important for governing the servo characteristics of the actuator and, therefore, the precision with which the reduction in diameters of the input shaft 1 and the output shaft 2 of conventional structure can be made has been limited. In the actuator according to this invention, the guide valve is formed so that the guide valve sleeve 30 and the guide valve plate 40 have the thrust surfaces thereof shaped as shown in FIGS. 3 and 4, respectively, whereby the opposing surfaces moving relative to each other have a large area and are easily formed.

In this actuator, as is apparent from the example shown in FIG. 6, it is possible to form passages for actuating oil in the arm (corresponding to 63 in FIG. 6) of the robot without providing piping employing resilient tubes which have hitherto been used.

A multi-step arrangement of actuators is possible, and hands and fingers of the robot can be given a high degree of freedom and be simple and compact without complicated piping.

The reasons for the above possibilities are as follows:

(1) A passage for actuating oil is formed within the output shaft, and main passages 41 and 48 are formed on the supply side and the discharge side at the left and right ends of said shaft, respectively.

(2) The output shaft 20 is fixed to an arm (housing 20) without any relative movement therebetween, and all passages are adapted to communicate with each other without using oil seals. For example, the connection between 64⟷41 and the between 65⟷48 are easy.

The above two conditions (1) and (2) can exist because the motor to drive the guide valve is contained within the hydraulic actuator and a face-opposed type guide valve is fabricated so as to be slidable on the output shaft 20, whereby the ends of the output shaft 20 can effectively be utilized.

INDUSTRIAL APPLICABILITY

This invention has successfully provided a compact mechanical servo actuator endowed with a high resolving power for position.

The application of a multi-step structure to actuators according to this invention is easy, and simple and compact structures of hands and fingers of a robot having a high degree of freedom without complicated piping are also possible.

Adjustment of the degree of freedom and provision of modules according to the requirements of the object to which this invention is applied are easy.

That actuator according to this invention can be widely utilized for various kinds of industrial robots and industrial machines, thereby exhibiting highly significant effects.

What is claimed is:

1. A hydraulic servo actuator, comprising:

an outer case;

a shaft extending through said case and rotatably mounted therein;

an input sleeve rotatably mounted on said shaft and having hydraulic fluid supply and discharge passages therein and having grooves in the surface thereof communicating with said passages;

an output member on said shaft and movably abutting said input sleeve and having hydraulic fluid supply and discharge passages therein and having grooves on the surface thereof communicating with said passages and being opposed to corresponding grooves on said input sleeve, said outer casing and said output member defining an actuating chamber therebetween into which said passages in said output member open, said actuating chamber being shaped for causing said output member and said outer case to rotate relative to each other and rotate said shaft and case relative to each other when hydraulic fluid supplied into said chamber from said passages under control of relative rotation of said input and output members creates an unbalanced pressure on parts of said actuating chamber; and motor means in said casing and having a stator fixed to said case, and a rotor connected to said sleeve, said passages and grooves being positioned relative to each other for, when said motor is actuated to drive said rotatable input sleeve relative to said output member away from a neutral position in which the pressure of the hydraulic fluid in said actuating chamber on the parts of said chamber is balanced, causing the hydraulic fluid in said actuating chamber to rotate said case and said output member in a direction tending to balance the hydraulic fluid pressure on the parts of said actuating chamber.

2. A hydraulic servo actuator as claimed in claim 1 in which said input sleeve has an axially facing surface and said output member has an axially facing surface opposed to said axially facing surface on said input sleeve, and said grooves are circumferential groove segments in said opposed axially facing surfaces which are movable into and out of communication with each other during relative rotation of said input sleeve and said output member.

3. A hydraulic servo actuator as claimed in claim 2 in which said circumferential groove segments on said input sleeve are in adjacent quadrants, and said axially facing surface of said input sleeve has further circumferential groove segments therein spaced diametrically opposite said firstmentioned groove segments, and said input sleeve has further hydraulic fluid supply passages therein extending to said further circumferential groove segments.

* * * * *